US009970702B2

(12) United States Patent
Ahn et al.

(10) Patent No.: US 9,970,702 B2
(45) Date of Patent: May 15, 2018

(54) DEFROSTING APPARATUS, REFRIGERATOR INCLUDING THE SAME, AND CONTROL METHOD THEREOF

(71) Applicant: SAMSUNG ELECTRONICS CO., LTD., Suwon-si (KR)

(72) Inventors: Sang-beom Ahn, Suwon-si (KR); Yang-gyu Kim, Gwangju (KR); Sinn-bong Yoon, Gwangju (KR); Jong-hoon Kim, Anyang-si (KR); Yong-sun Song, Gwangju (KR); Han-sol Choi, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 113 days.

(21) Appl. No.: 14/930,973

(22) Filed: Nov. 3, 2015

(65) Prior Publication Data

US 2016/0123649 A1 May 5, 2016

(30) Foreign Application Priority Data

Nov. 5, 2014 (KR) ..... 10-2014-0152611

(51) Int. Cl.
*F25D 21/08* (2006.01)
*F25D 21/00* (2006.01)

(52) U.S. Cl.
CPC ..... *F25D 21/08* (2013.01); *F25D 21/006* (2013.01)

(58) Field of Classification Search
CPC ..... F25D 21/00; F25D 21/02; F25D 21/06; F25D 21/08; F25D 21/002; F25D 21/006; B60H 1/00778; B60H 1/004; B60H 1/00428; B60H 1/323
USPC ..... 62/80, 155, 156
See application file for complete search history.

(56) References Cited

U.S. PATENT DOCUMENTS 3,103,796 A * 9/1963 Dickson ..... A47F 3/0447 62/199
5,460,010 A 10/1995 Kobayashi et al.
2010/0139300 A1* 6/2010 Jeong ..... F25D 17/042 62/186
2010/0154443 A1* 6/2010 Chun ..... F25D 21/006 62/80
2010/0326096 A1* 12/2010 Junge ..... F25C 5/005 62/82

(Continued)

FOREIGN PATENT DOCUMENTS

JP 2014-009892 1/2014
WO 2013/004043 1/2013

OTHER PUBLICATIONS

Translation of JP 2014009892 Hayashi et al.*
Extended European Search Report dated Mar. 14, 2016 in European Patent Application No. 15186941.9.

*Primary Examiner* — Mohammad M Ali
(74) *Attorney, Agent, or Firm* — Staas & Halsey

(57) ABSTRACT

A defrosting apparatus includes: an evaporator; a defrosting heater removing frost formed on the evaporator; and a controller controlling the defrosting heater until defrosting for the evaporator is completed when a driving start command for the defrosting apparatus is input, wherein the controller controls the defrosting heater to have an idle section in which the defrosting heater is not operated between a point in time in which the driving start command is input and a point in time in which the defrosting is completed.

14 Claims, 9 Drawing Sheets

(56) References Cited

U.S. PATENT DOCUMENTS

| | | | | |
|---|---|---|---|---|
| 2011/0185755 | A1* | 8/2011 | Kim | F25D 21/08 62/155 |
| 2012/0023975 | A1* | 2/2012 | Yoon | F25D 11/022 62/81 |
| 2012/0055179 | A1* | 3/2012 | Junge | F25D 21/08 62/80 |
| 2012/0198863 | A1* | 8/2012 | Hall | F25D 21/08 62/80 |
| 2013/0081416 | A1* | 4/2013 | Kim | F25D 21/006 62/151 |
| 2013/0098078 | A1* | 4/2013 | Contreras Lafaire | F25D 21/06 62/82 |
| 2013/0192280 | A1* | 8/2013 | Kim | F25D 21/06 62/80 |
| 2014/0033744 | A1* | 2/2014 | Kim | F25D 21/002 62/80 |

* cited by examiner

DEFROSTING APPARATUS, REFRIGERATOR INCLUDING THE SAME, AND CONTROL METHOD THEREOF

CROSS-REFERENCE TO RELATED APPLICATIONS

This application claims the priority benefit of Korean Patent Application No. 10-2014-0152611, filed on Nov. 5, 2014, in the Korean Intellectual Property Office, the disclosure of which is incorporated herein by reference in its entirety.

BACKGROUND

1. Field

The following description relates to a defrosting apparatus, a refrigerator including the same, and a control method thereof, and more particularly, to a defrosting apparatus capable of improving energy efficiency by discontinuously controlling an operation of the defrosting apparatus, a refrigerator including the same, and a control method thereof.

2. Description of the Related Art

Generally, a refrigerator is an apparatus maintaining a storage chamber in the refrigerator at a low temperature in order to freshly store foods for a long period of time.

The refrigerator changes a state of a refrigerant flowing along an inner portion of a refrigerant pipe to allow a heat exchange of the refrigerant to be performed at the interior and the exterior of the refrigerator, thereby lowering an indoor temperature.

In detail, the refrigerator is configured to include an evaporator absorbing ambient heat while evaporating a low pressure and low temperature refrigerant, thereby performing a heat exchange with indoor air of the storage chamber.

Frost may form on an outer surface of the evaporator that is in a low temperature state due to a temperature difference between water vapor introduced from the exterior that is in a room temperature state into the refrigerator or water vapor generated by evaporation of moisture contained in foods stored in the refrigerator and the evaporator.

Because the frost formed on the surface of the evaporator decreases heat exchange efficiency which, in turn, decreases cooling efficiency of the refrigerator and increases power consumption, a defrosting apparatus for removing the frost is provided in the refrigerator.

In the case of a defrosting apparatus removing the frost of the evaporator using a heated wire according to the related art, in order to ensure that the frost of the evaporator has been completely removed, a temperature of the evaporator at a position of the evaporator that is farthest from the heat wire is sensed, and a defrosting operation is continuously performed until the temperature of the evaporator arrives at a temperature at which defrosting is completed.

In the defrosting scheme according to the related art as described above, excessive heat is applied to a portion of the evaporator positioned closely to the heated wire, and an amount of heat equal to or larger than an amount of heat required for removing the frost is used.

Therefore, the refrigerator according to the related art has an increase in power consumption caused at the time of a defrosting operation, heat remaining after the defrosting operation meets cold air within the refrigerator forms dew or frost within the refrigerator, foods go bad due to a temperature rise within the refrigerator, and an increase in a time in which a cooling apparatus is operated in order to again lower a temperature excessively rising after the defrosting operation causes an increase in power consumption and a decrease in a lifespan of the refrigerator.

SUMMARY

According to an aspect of the present disclosure, a defrosting apparatus may include an evaporator; a defrosting heater removing frost formed on the evaporator; and a controller controlling the defrosting heater until the defrosting for the evaporator is completed when a driving start command for the defrosting apparatus is input, wherein the controller controls the defrosting heater to have an idle section in which the defrosting heater is not operated between a point in time in which the driving start command is input and a point in time in which the defrosting is completed.

The controller may control the defrosting heater until a temperature in the vicinity of the evaporator arrives at a predetermined temperature, thereby completing the defrosting for the evaporator.

The controller may control the defrosting heater to have the idle section at a temperature at which a phase change of the frost formed on the evaporator is made.

The controller may control the defrosting heater to be operated until the temperature in the vicinity of the evaporator arrives at the predetermined temperature when a temperature at which a phase change of the frost is completed is confirmed.

The controller may control the defrosting heater to be additionally operated when the phase change of the frost is not completed for a predetermined time in the idle section.

The controller may control the defrosting heater to have at least one heating section in which the defrosting heater is operated for a predetermined heating time until the temperature in the vicinity of the evaporator arrives at the predetermined temperature and at least one idle section in which the defrosting heater is stopped for a predetermined idle time.

The controller may increase the numbers of heating sections and idle sections depending on whether or not a temperature in the vicinity of the evaporator arrives at a temperature at which a phase change of the frost is completed when the predetermined idle time elapses.

The controller may control the defrosting heater to further have one heating section and one idle section in the case in which it is confirmed that the temperature in the vicinity of the evaporator is 0° C. or less, when the predetermined idle time elapses.

The controller may control the defrosting heater to be operated until the temperature in the vicinity of the evaporator arrives at the predetermined temperature when the temperature at which the phase change of the frost is completed is confirmed.

The defrosting apparatus may further include a temperature sensor sensing a temperature in the vicinity of the evaporator, wherein the defrosting heater is disposed below the evaporator, and the temperature sensor is mounted above the evaporator.

According to an aspect of the present disclosure, a control method of a defrosting apparatus including a defrosting heater for removing frost formed on an evaporator includes: inputting a driving start command for the defrosting apparatus; and controlling the defrosting heater until a temperature in the vicinity of the evaporator arrives at a predetermined temperature, wherein in the controlling, the defrosting heater is controlled to have an idle section in which the defrosting heater is not operated between a point in time in which the driving start command is input and a point in time in which the temperature in the vicinity of the evaporator arrives at the predetermined temperature.

In the controlling, the defrosting heater may be controlled to have the idle section at a temperature at which a phase change of the frost formed on the evaporator is made.

In the controlling, the defrosting heater may be controlled to be operated until the temperature in the vicinity of the evaporator arrives at the predetermined temperature when the temperature at which the phase change of the frost is completed is confirmed.

In the controlling, the defrosting heater may be controlled to be additionally operated when the phase change of the frost is not completed for a predetermined time in the idle section.

In the controlling, the defrosting heater may be controlled to have at least one heating section in which the defrosting heater is operated for a predetermined heating time until the temperature in the vicinity of the evaporator arrives at the predetermined temperature and at least one idle section in which the defrosting heater is stopped for a predetermined idle time.

In the controlling, the numbers of heating sections and idle sections may be increased depending on whether or not the temperature in the vicinity of the evaporator arrives at a temperature at which a phase change of the frost is completed when the predetermined idle time elapses.

In the controlling, the defrosting heater may be controlled to further have one heating section and one idle section in the case in which it is confirmed that the temperature in the vicinity of the evaporator is 0° C. or less, when the predetermined idle time elapses.

In the controlling, the defrosting heater may be controlled to be operated until the temperature in the vicinity of the evaporator arrives at the predetermined temperature when the temperature at which the phase change of the frost is completed is confirmed.

According to an aspect of the present disclosure, a refrigerator including a defrosting apparatus includes an evaporator performing a heat exchange in order to lower a temperature within a storage chamber of the refrigerator; a defrosting heater removing frost formed on the evaporator; and a controller controlling the defrosting heater until a temperature in the vicinity of the evaporator arrives at a predetermined temperature when a driving start command for a defrosting operation is input, wherein the controller controls the defrosting heater to have an idle section in which the defrosting heater is not operated between a point in time in which the driving start command is input and a point in time in which the temperature in the vicinity of the evaporator arrives at the predetermined temperature.

According to an aspect of the present disclosure, a computer readable recording medium includes a program for executing a control method of a defrosting apparatus including a defrosting heater for removing frost formed on an evaporator, wherein the control method of a defrosting apparatus includes: inputting a driving start command for the defrosting apparatus; and controlling the defrosting heater until a temperature in the vicinity of the evaporator arrives at a predetermined temperature, wherein in the controlling, the defrosting heater is controlled to have an idle section in which the defrosting heater is not operated between a point in time in which the driving start command is input and a point in time in which the temperature in the vicinity of the evaporator arrives at the predetermined temperature.

BRIEF DESCRIPTION OF THE DRAWINGS

The above and/or other aspects of the present disclosure will be more apparent by describing certain exemplary embodiments of the present disclosure with reference to the accompanying drawings, in which.

DETAILED DESCRIPTION

Hereinafter, exemplary embodiments of the present disclosure will be described in detail with reference to the accompanying drawings.

Figure 1:
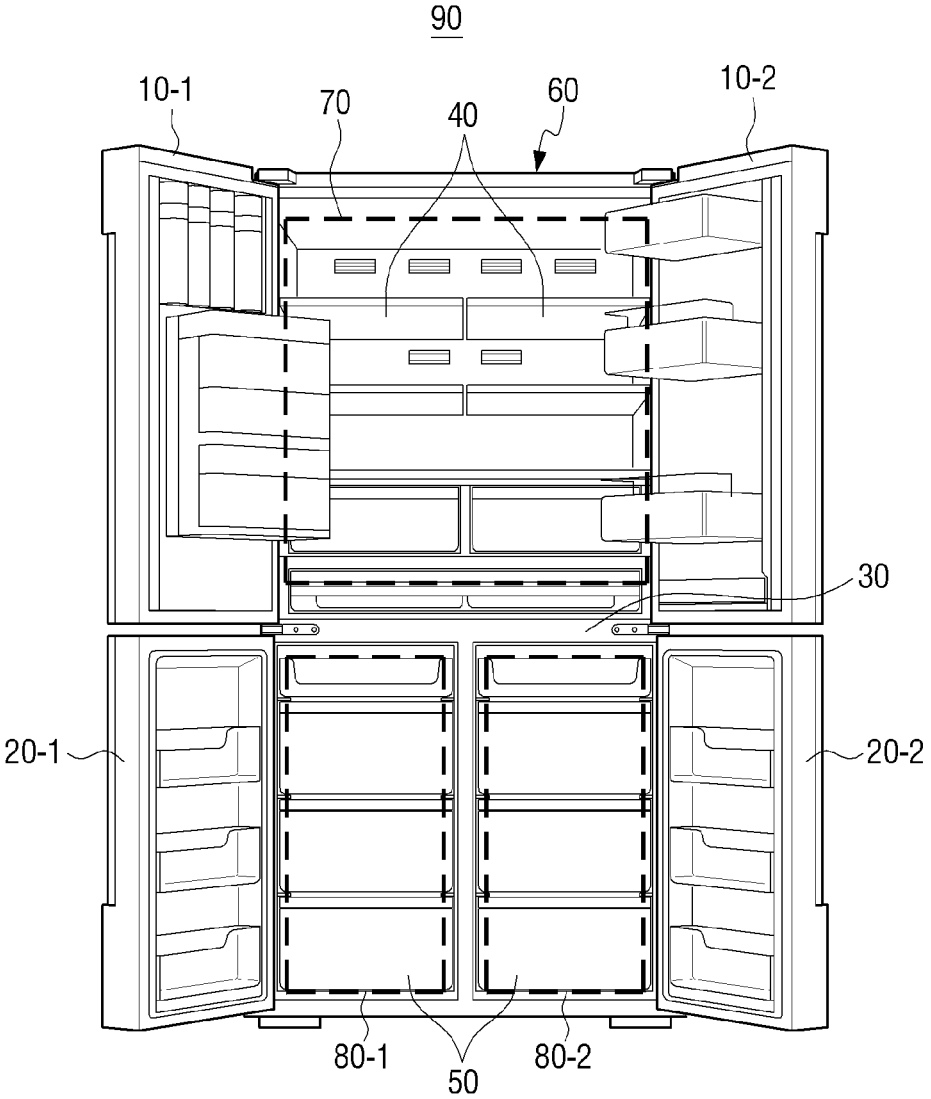
FIG. 1 is a front view of a refrigerator according to an exemplary embodiment of the present disclosure.

FIG. 1 is a front view of a refrigerator according to an exemplary embodiment of the present disclosure.

Referring to FIG. 1, a refrigerator 90 is configured to include a body 60, a T-shaped partition wall 30, refrigerating chamber doors 10-1 and 10-2, and freezing chamber doors 20-1 and 20-2.

The body 60 forms an appearance of the refrigerator 90 and a storage space in which foods are to be stored in the refrigerator 90. In detail, the refrigerator 90 may have a rectangular parallelepiped appearance, and have an empty space formed therein and containing a heat insulation material.

The T-shaped partition wall 30 includes a horizontal partition wall and a vertical partition wall and is formed in the body to partition the storage space of the refrigerator 90 into a refrigerating chamber 70 and a freezing chamber 80 and partition the freezing chamber 80 into a left space 80-1 and a right space 80-2.

The refrigerating chamber 70 and the freezing chamber 80 partitioned by the T-shaped partition wall 30 are installed with a plurality of shelves 40 and boxes 50 in order to effectively and conveniently store food.

The refrigerating chamber doors 10-1 and 10-2 are coupled to the body 60 by hinges in front of the refrigerating chamber 70 to open or close the refrigerating chamber 70. Here, the refrigerating chamber doors 10-1 and 10-2 may be a side-by-side type configured with a refrigerating chamber left door 10-1 and a refrigerating chamber right door 10-2.

The freezing chamber doors 20-1 and 20-2 are coupled to the body 60 by hinges in front of the freezing chambers 80-1 and 80-2 to open or close the freezing chambers 80-1 and 80-2. Here, the freezing chamber doors 20-1 and 20-2 may be a side-by-side type configured with a freezing chamber left door 20-1 opening or closing the left space 80-1 of the freezing chamber and a freezing chamber right door 20-2 opening or closing the right space 80-2 of the freezing chamber.

The refrigerating chamber doors 10-1 and 10-2 and the freezing chamber doors 20-1 and 20-2 are installed with a plurality of shelves and boxes in order to effectively and conveniently store and use food.

Although not shown, a pipe through which a refrigerant is circulated in a cooling cycle is formed in a mechanical chamber provided in a rear surface of the body 90, and evaporators for performing a heat exchange are disposed at the rear of each of the refrigerating chamber 70 and the freezing chamber 80.

The evaporators may be disposed in cooling chambers, which are spaces closed by a heat insulation material, at the rear of each of the refrigerating chamber 70 and the freezing chamber 80. In addition, cool air of which heat is taken away by the evaporators may be introduced into the refrigerating chamber 70 and the freezing chamber 80 through cool air outlets.

In addition, air of the refrigerating chamber 70 and the freezing chamber 80 may be introduced into the cooling chambers in which the evaporators are installed through inlets to perform a heat exchange with the evaporators.

Meanwhile, a defrosting apparatus may be provided in the vicinity of the evaporator to remove frost formed on the evaporators. In detail, the defrosting apparatus may include a defrosting heater disposed in the vicinity of evaporator and operate the defrosting heater to diffuse heat when a defrosting operation for removing the frost formed on the evaporator starts, thereby removing the frost.

Here, the defrosting apparatus controls the defrosting heater to be discontinuously operated when the defrosting is completed, thereby making it possible to secure a time in which the heat generated by the defrosting heater may be convected and diffused. A detailed description for this will be provided below with reference to FIG. 2.

Although the case in which the refrigerating chamber 70 and the freezing chamber 80 are provided with separate evaporators, respectively, to perform independent cooling has been described hereinabove, one evaporator may adjust a flow rate of the cool air introduced to the refrigerating chamber 70 and the freezing chamber 80 at the time of implementation.

Figure 2:
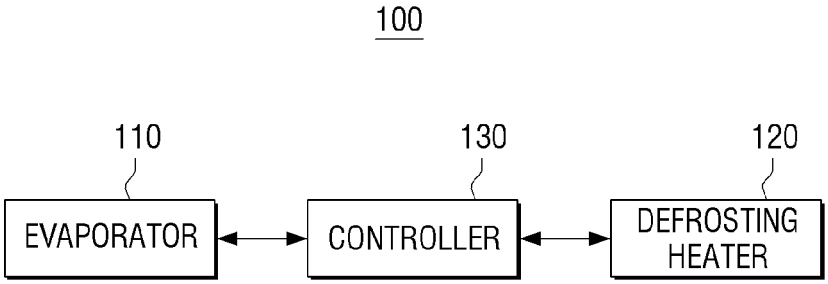
FIG. 2 is a block diagram illustrating a simple configuration of a defrosting apparatus according to an exemplary embodiment of the present disclosure.

FIG. 2 is a block diagram illustrating a simple configuration of a defrosting apparatus according to an exemplary embodiment of the present disclosure.

Referring to FIG. 2, a defrosting apparatus 100 is configured to include an evaporator 110, a defrosting heater 120, and a controller 130.

The evaporator 110 performs a heat exchange. In detail, the evaporator 110 may perform a heat exchange with indoor air of the refrigerator 90.

The evaporator 110 allows a refrigerant that is in a low temperature and low pressure liquid state to move along a pipe of the evaporator 110 depending on a cooling cycle of the refrigerant, thereby making it possible to evaporate the refrigerant. In addition, the evaporator 110 may absorb heat required when the refrigerant is evaporated from ambient air. Therefore, cool air cooled by the evaporator may be formed in the vicinity of the evaporator 110.

Here, because relative humidity becomes low in the vicinity of the evaporator 110 due to cooled air, a dew condensation phenomenon that water vapor included in air passing through the evaporator 110 is condensed may occur. In addition, water of which a temperature is lowered to a solidifying point or less may be frozen, such that frost may be formed on a surface of the evaporator 110. Alternatively, water vapor in the air is sublimated while colliding with the surface of the evaporator 110 that is in a low temperature state, such that it may become the frost.

The defrosting heater 120 removes the frost formed on the evaporator 110. In detail, the defrosting heater 120 may generate heat to melt the frost formed on the evaporator 110.

The defrosting heater 120 may be formed of various kinds of heat wires generating heat when power is applied thereto. For example, the defrosting heater 120 may be a sheath heater in which a heat wire is wound in a bent metal pipe.

The number of defrosting heaters 120 may be one or more, and types of a plurality of defrosting heaters 120 may be different from each other. For example, the defrosting heater 120 may include at least one of a planar plate heater facing the evaporator, a cord heater disposed to correspond to a refrigerant pipe of the evaporator, and an external heater disposed below the evaporator to be spaced apart from the evaporator.

The controller 130 controls each component of the defrosting apparatus 100. In detail, the controller 130 may control each component of the defrosting apparatus 100 for a defrosting operation of removing the frost on the evaporator.

The controller 130 receives a driving start command. In detail, the controller 130 may decide whether the driving start command allowing the defrosting operation of the defrosting apparatus 100 to be performed is input.

Here, the driving start command may be a signal sensed by an external sensor, and may be a command generated by the controller 130 in the case in which information input to the controller 130 satisfies a predetermined condition. For example, the driving start command may be transmitted to the controller 130 when a cumulative time from a timer for an operation time of a compressor arrives at a predetermined time in which the defrosting is required. In addition, the driving start command may be issued by a sensor measuring an amount of accumulated frost formed on the evaporator 110 using a light or a sensor measuring an amount of accumulated frost formed on the evaporator 110 by measuring an electric capacity between heat exchangers of the evaporator.

The number of cases in which the driving start command is input is not limited thereto. That is, the driving start command may be designed so that the defrosting may start under various conditions. In detail, the driving start command may be designed so that the defrosting is more frequently performed depending on an environment (humidity, or the like) of a zone, or environment, in which the refrigerator 90 is used, and be issued so that the defrosting depends on a frequency at which the doors 10 and 20 are opened and closed when the doors 10 and 20 are frequently opened or closed depending on a user's use habit. For example, because external air is frequently introduced into the refrigerator when the user frequently opens or closes the doors 10 and 20, the driving start command may be input to the controller 130 so that the defrosting starts when the total number of opening and closing arrives at a predetermined number in order to remove the frost generated due to hot and humid air. In addition, the driving start command may be input to the controller 130 so that the defrosting starts when a time in which the doors 10 and 20 are opened is accumulated to arrive at a predetermined time. In addition, in order to perform the defrosting adaptively to an environment varied depending on a season, a temperature sensor or a humidity sensor may be attached to a storage chamber to allow the defrosting to be performed depending on a temperature difference between the storage chamber and the outside of the refrigerator or humidity introduced from the outside of the refrigerator.

Defrosting start conditions such as the predetermined number, the time, the temperature, the humidity, and the like, as described above, may be variously set depending on purposes, use schemes, and designs of products such as a general refrigerator, a Kimchi refrigerator, a rice refrigerator, and the like.

Although the case in which the controller 130 receives the driving start commands from external separate components has been described in the above-mentioned exemplary embodiment, the controller 130 may directly detect a state of the frost formed on the evaporator 110 or add up a driving time of the compressor and perform a control for the defrosting when a predetermined condition is satisfied, as one module, at the time of implementation.

The controller 130 controls the defrosting heater 120 until the defrosting operation is completed. In detail, the controller 130 may control the defrosting heater 120 until predetermined defrosting completion conditions are satisfied.

Here, the defrosting completion conditions under which the defrosting operation of removing the frost on the evaporator 110 is completed may vary depending on an actual implementation. For example, the defrosting completion conditions may be a defrosting operation time, total consumed power, an amount of disused heat, and the like, from after the defrosting starts until the defrosting is completely performed in consideration of a capacity of the storage chamber, disposition, and a size of the cooling chamber, power (kJ/s or kW) of the defrosting heater 120, and the like, designed for each model of the refrigerator 90.

The defrosting completion conditions, such as a time in which the defrosting operation is driven until the defrosting operation is completed, energy consumed at the time of performing the defrosting, and the like, may be set to be adaptively varied depending on several variables, similar to the defrosting start conditions. In detail, the defrosting start condition may be the same, but more defrosting time is more required due to environmental changes. For example, a cumulative driving time of the compressor to start the defrosting may be constant. However, in summer, when humidity is relatively high and the refrigerant is frequently used, because the formation of frost is increased, the defrosting operation may be set to be driven for a longer time. The defrosting operation time and an amount of energy to be consumed at the time of performing the defrosting may be set to values at which the defrosting may be optimally performed depending on a use environment, a model, a purpose, a design, and a form of a product.

Meanwhile, the defrosting completion condition may be a condition depending on a signal sensed from a sensor. For example, the defrosting completion condition may be a condition depending on a temperature sensed by a temperature sensor disposed in the vicinity of the evaporator 110 and be a condition depending on a signal sensed from an optical sensor sensing light reflected on the evaporator 110 in light irradiated toward the evaporator 110 or a sensor measuring the electric capacity between the heat exchangers of the evaporator.

Next, the defrosting completion condition will be described as an example that depends on a temperature in the vicinity of the evaporator 110.

The controller 130 may control the defrosting heater 120 to operate until the temperature in the vicinity of the evaporator 110 arrives at a predetermined temperature. In detail, the controller 130 may control the defrosting heater 120 to operate until the temperature in the vicinity of the evaporator 110 rises to arrive at a predetermined temperature enough to remove the frost formed on the evaporator 110.

For example, the controller 130 may control the defrosting heater 120 to perform an operation of generating heat when the driving start command is input. In this case, power is applied to the heat wire of the defrosting heater 120 depending on a control signal of the controller 130, such that the heat may be generated in the defrosting heater 120.

Here, the predetermined temperature may be a temperature high enough to completely remove the frost formed on the evaporator 110. The predetermined temperature may be a temperature indicating the defrosting has ended, and be higher than a temperature at which ice present at a position at which the temperature is measured is converted into water. The predetermined temperature may be a temperature high enough to prevent remaining ice or water that may partially remain in the cooling chamber from being again frozen at the time of a cooling operation of the evaporator 110.

The controller 130 controls the defrosting heater to have an idle section in which the defrosting heater is not operated from an input of the driving start command until the defrosting for the evaporator 110 is completed. In detail, the controller 130 may control the defrosting heater 120 to perform an intermittent operation from a start of the defrosting operation of removing the frost up to an end of the defrosting operation at which the temperature in the vicinity of the evaporator arrives at the predetermined temperature.

In this case, the controller 130 may control the defrosting heater 120 to have an idle section at a temperature at which a phase change of the frost formed on the evaporator 120 is made. In detail, the controller 130 may control the defrosting heater 120 not to be operated at a temperature of 0° C. at which the phase change of the frost is made.

The defrosting operation starts, and heat locally applied to the defrosting heater 120 rises relatively steeply until it arrives at the temperature at which the phase change starts. However, it takes a significant time for radiant heat generated in the defrosting heater 120 to be transferred by convection to the entire frost formed on the evaporator 110 by a quantity of latent heat required for decomposing a crystal of ice into water.

Therefore, because a continuous operation of the defrosting heater 120 until the entire frost is removed by heat convection generates an excessive amount of heat, the controller 130 allows the defrosting heater to have the idle section in which the heat generated in the defrosting heater 120 may be transferred to the frost on the evaporator 110 in a phase change section in which most of the amount of heat is consumed in the defrosting operation.

In addition, the controller 130 may control the defrosting heater 120 to be operated until the temperature in the vicinity of the evaporator arrives at the predetermined temperature when a temperature at which the phase change of the frost is completed is confirmed. In detail, when the temperature at which the phase change of the entire frost formed on the evaporator is completed is sensed, the controller 130 controls the defrosting heater 120 that is in operation to be continuously operated or controls the defrosting heater 120 that is in an idle state to resume an operation until the temperature in the vicinity of the evaporator arrives at the predetermined temperature, thereby making it possible to rapidly end the defrosting operation without having an additional idle section. In a state in which the phase change into the water is completed, because the frost formed on the evaporator 110 is removed and a heat transfer for the remaining ice may be rapidly performed, a continuous operation of the defrosting heater up to a predetermined temperature at a point in time in which the phase change is completed may shorten a defrosting operation time.

Meanwhile, the controller 130 may control the defrosting heater 120 to be additionally operated when the phase change of the frost is not completed for the predetermined time in the idle section. In detail, when it is decided that the phase change of the frost is not completed even after the heat is diffused for the predetermined time, the controller 130 may control the defrosting heater 120 that is in the idle state to be again operated, thereby generating heat for the defrosting.

The controller 130 may control the defrosting heater 120 to be additionally operated for a predetermined time and then have again an idle section. In the control of the controller 130 for the defrosting heater 120 that depends on the sensed temperature, the defrosting heater 120 may be experimentally predetermined to have optimized additional operations and idle sections in a relationship between a diffusion time of the heat, an amount of the frost accumulated at the time of starting the defrosting operation, a defrosting operation time, and the like, depending on size forms of the evaporator 110 and the cooling chamber, a disposition structure of the defrosting heater 120, and the like.

The controller 130 may control the defrosting heater 120 to have at least one heating section in which the defrosting heater 120 is operated for a predetermined heating time and at least one idle section in which the defrosting heater 120 is stopped for a predetermined idle time until the defrosting is completed. In detail, the controller 130 may control the defrosting heater 120 to be operated for the predetermined heating time and control the defrosting heater 120 not to be operated for the predetermined idle time, when the driving start command is input. In addition, the controller 130 allows the defrosting heater 120 to have one or more idle time up to the end of the defrosting at which the temperature in the vicinity of the evaporator arrives at the predetermined temperature, thereby making it possible to secure a time in which the heat generated in the defrosting heater 120 may be diffused.

In this case, the controller 130 may increase the numbers of heating sections and idle sections depending on whether or not the temperature in the vicinity of the evaporator arrives at a temperature at which the phase change of the frost is completed when the predetermined idle time elapses. In detail, the controller 130 may confirm whether the sensed temperature indicates the temperature at which the phase change of the frost is completed whenever the predetermined idle time elapses and control the defrosting heater 120 to have an additional heating section and idle section in the case in which the frost is yet in an ice state or ice that is being phase-changed and water are mixed with each other.

In addition, the controller 130 may control the defrosting heater 120 to further have one heating section and one idle section in the case in which it is confirmed that the temperature in the vicinity of the evaporator 110 is 0° C. or less, when the predetermined idle time elapses. In detail, the controller 130 may control the defrosting heater 120 to further have one heating section and one idle section in the case in which the sensed temperature is 0° C. or less, such that the frost is not yet changed into the water, when the predetermined idle time elapses.

In addition, the controller 130 may control the defrosting heater 120 to be operated until the temperature in the vicinity of the evaporator arrives at the predetermined temperature, when the temperature at which the phase change of the frost is completed is confirmed. In detail, the controller 130 may control the defrosting heater 120 to resume the operation until the temperature in the vicinity of the evaporator arrives at the predetermined temperature for ending the defrosting operation when the temperature at which the phase change is completed is confirmed during a period in which it controls the defrosting heater 120 to have the heating section and the idle section.

The controller 130 may include a central processing unit (CPU), a read only memory (ROM) storing a control program for controlling each component of the defrosting apparatus 100 therein, and a random access memory (RAM) storing signals or data input from the outside of the defrosting apparatus 100 therein or used as a memory region for processes performed by the defrosting apparatus 100. The CPU may be at least one of a single core processor, a dual core processor, a triple core processor, and a quad core processor. The CPU, the ROM, and the RAM may be connected to each other through internal buses. The CPU may execute instructions included in the program for controlling each component of the defrosting apparatus 100.

In the defrosting apparatus 100 according to an exemplary embodiment of the present disclosure as described above, the defrosting heater is controlled to be discontinuously operated at the time of the defrosting operation, thereby making it possible to improve energy efficiency at the time of the defrosting operation and food storing performance of the refrigerator.

Figure 3:
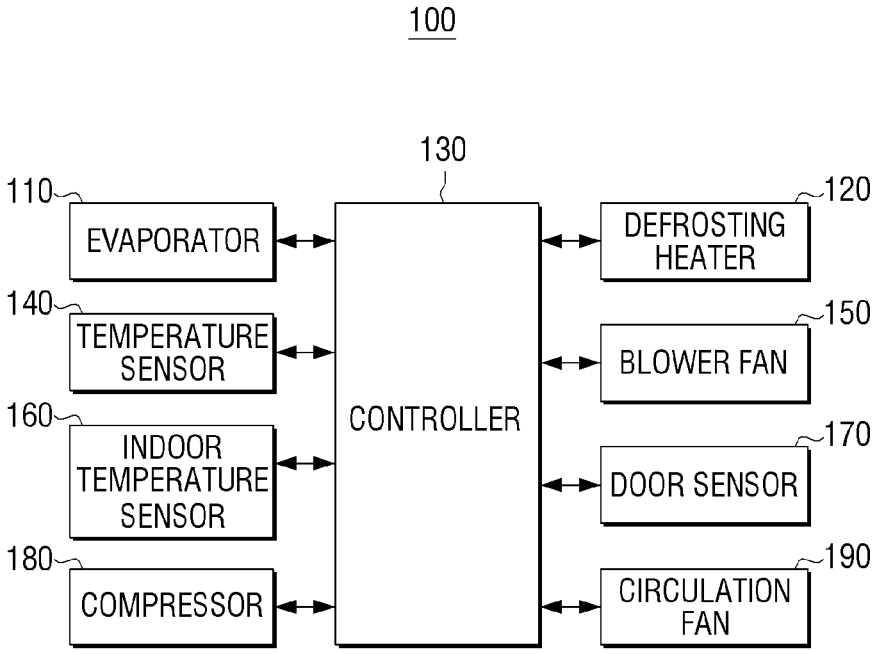
FIG. 3 is a block diagram illustrating a detailed configuration of the defrosting apparatus of FIG. 2.

FIG. 3 is a block diagram illustrating a detailed configuration of the defrosting apparatus of FIG. 2.

Referring to FIG. 3, the defrosting apparatus 100 is configured to include the evaporator 110, the defrosting heater 120, the controller 130, a temperature sensor 140, a blower fan 150, an indoor temperature sensor 160, a door sensor 170, a compressor 180, and a circulation fan 190. Here, because the operations and the functions of the evaporator 110, the defrosting heater 120, and the controller 130 have been described with reference to FIG. 2, an overlapped description therefore will be omitted.

The temperature sensor 140 senses the temperature in the vicinity of the evaporator 110. In detail, the temperature sensor 140 may be disposed at one side of the evaporator to recognize the phase change of the frost formed on the evaporator 110, and may sense the temperature.

Here, the temperature sensor 140 may be mounted at an opposite side to a position at which the defrosting heater 120 is disposed based on the evaporator 110 in order to ensure that the frost formed on the evaporator 110 is completely removed. For example, in the case in which the defrosting heater 120 is disposed below the evaporator 110, the temperature sensor 140 may be mounted above the evaporator 110.

The blower fan 150 generates a flow of air so that air within the refrigerator may be introduced into the cooling chamber through a duct provided in a rear wall and cool air heat-exchanged with the evaporator 110 may be discharged into the refrigerator.

The indoor temperature sensor 160 senses an indoor, or interior, temperature of the storage chamber. In detail, the indoor temperature sensor 160 may be disposed within the refrigerator and sense a temperature of air.

The door sensor 170 senses whether the refrigerating chamber door 10 or the freezing chamber door 20 of the refrigerator 90 is opened or closed.

The compressor 180 compresses the refrigerant. In detail, the compressor 180 may include a motor for compressing the refrigerant to provide power circulating the refrigerant.

The circulation fan 190 provides wind power so that the heat generated in the defrosting heater 120 may be convected within the cooling chamber. In detail, the circulation fan 190 may be disposed within the cooling chamber in which the evaporator 110 and the defrosting heater 120 are positioned and forcibly convect hot air generated in the defrosting heater 120 to be rapidly diffused to the frost formed on the evaporator 110 at the time of the defrosting operation.

Although the circulation fan 190 and the blower fan 150 have been described as separate components performing independent functions in an example illustrated in FIG. 3, one fan may be designed to provide power for discharging the cool air from the cooling chamber into the refrigerator and power for convecting internal air of the cooling chamber at the time of implementation.

The controller 130 controls the defrosting heater 120 at the time of the defrosting operation depending on the temperature in the vicinity of the evaporator 110 sensed by the temperature sensor 140. Because the functions and the operations of the controller 130 controlling the defrosting heater 120 have been described above with reference to FIG. 2, a detailed description therefore will be omitted.

The controller 130 may stop an operation of the blower fan 150 and the compressor 180 for the purpose of cooling and operate the circulation fan 190 for the purpose of convecting hot air at the time of the defrosting operation when the driving start command is input.

The controller 130 may control the operation of the compressor 180 so that the indoor temperature is maintained in a predetermined range depending on the temperature sensed by the indoor temperature sensor 160. In detail, the controller 130 may control the operation of the compressor 180 to be stopped when the indoor temperature in the vicinity of the evaporator arrives at a predetermined minimum temperature and to start when the indoor temperature arrives at a predetermined maximum temperature. In this case, the controller 130 may add up a time in which the compressor 180 is operated to decide whether or not the defrosting operation is required.

The controller 130 may control an illumination device installed in the refrigerator to be turned on or off or control a duct through which the cool air is discharged and the air within the refrigerator is introduced to be opened or closed, depending on whether the door is opened or closed sensed by the door sensor 170.

The defrosting apparatus 100 according to an exemplary embodiment of the present disclosure as described above controls the defrosting heater to be discontinuously operated at the time of the defrosting operation, thereby making it possible to improve energy efficiency at the time of the defrosting operation and food storing performance of the refrigerator. Next, a structure of the defrosting apparatus capable of improving thermal efficiency in this control scheme will be described with reference to FIG. 4.

Figure 4:
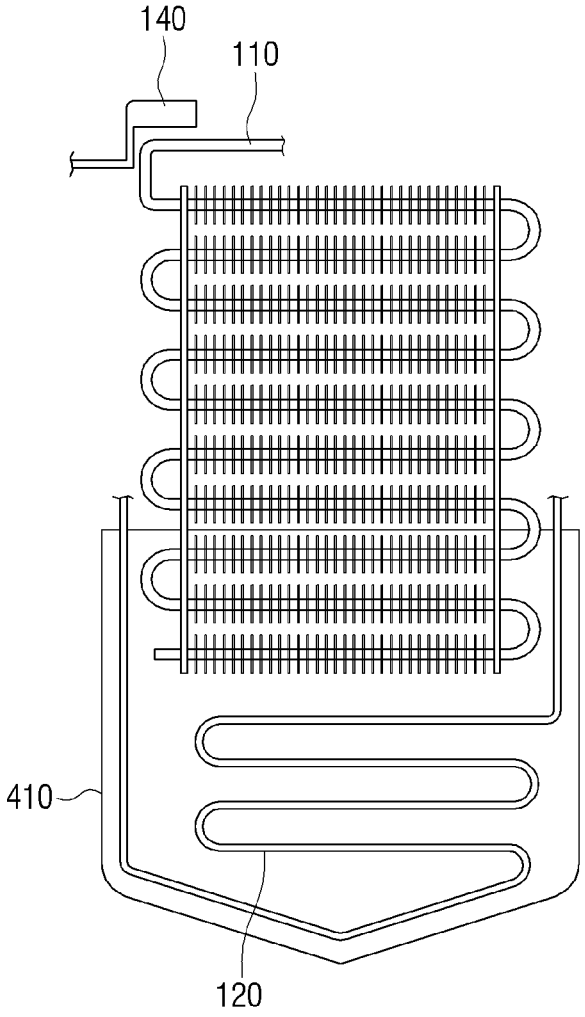
FIG. 4 is a diagram illustrating a structure of the defrosting apparatus of FIG. 2.

FIG. 4 is a diagram illustrating a structure of the defrosting apparatus of FIG. 2.

Referring to FIG. 4, the evaporator 110, the defrosting heater 120, the temperature sensor 140, and a defrosted water receiver 410 are illustrated.

The evaporator 110 may have a structure in which a plurality of heat exchanging pins are inserted into a thin and long refrigerant pipe bent several times in a U shape so that a liquid-state refrigerant absorbs heat of air passing through the surrounding thereof to thereby be easily evaporated.

In addition, the defrosting heater 120 generating the heat is disposed below the evaporator 110. Here, because a capacity of heat that may be generated and a magnitude of power that may be applied per unit length of the defrosting heater 120 are limited, the defrosting heater 120 may be bent in various shapes in order to increase a capacity of heat that is to be generated in a predetermined space.

The defrosting heater 120 may be disposed below the evaporator 110 to allow air heated by the defrosting heater 120 to ascend, thereby removing the frost at an upper portion of the evaporator 110.

The defrosted water receiver 410 receiving defrosted water generated by melting the frost and falling by gravity is disposed below the evaporator 110 and the defrosting heater 120. A lower surface of the defrosted water receiver 410 may be perforated in order to discharge the defrosted water.

The temperature sensor 140 is positioned above the evaporator 110. The temperature sensor 140 may be disposed above the evaporator 110 to make it possible to recognize whether or the frost is completely removed up to the upper portion of the evaporator 110 by the heat of the defrosting heater 120.

When the defrosting operation is started in the structure of the defrosting apparatus according to an example as described above, most of the heat generated by the defrosting heater 120 is absorbed in the frost formed at a lower portion of the evaporator 110.

Next, the reason why a control scheme of the defrosting apparatus of FIG. 2 or FIG. 3 in the structure of the defrosting heater of FIG. 4 improves efficiency will be described together with a phase change graph of FIG. 5.

Figure 5:
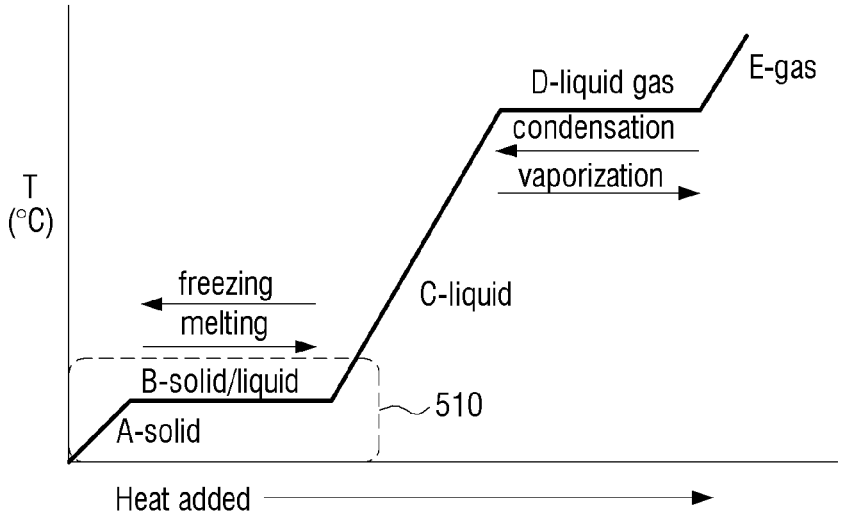
FIG. 5 is a graph illustrating a section in which a phase transition of ice is made as heat is applied to the ice in a closed system.

FIG. 5 is a graph illustrating a section in which a phase transition of ice is made as heat is applied to the ice in a closed system.

Referring to FIG. 5, when the heat is applied to the ice that is in a low temperature solid state at the early stage, a temperature of the ice rises at a predetermined gradient depending on specific heat of the ice (Section A). Then, when the temperature of the ice arrives at a temperature at which a phase change starts, the temperature of the ice does not rise, and water and the ice coexist with each other while maintaining phase equilibrium. In this Section B, supplied heat is absorbed as latent heat for a phase transition that the ice is melted to become water.

Then, when a state change to the water that is in a liquid state is completed, a temperature of the water rises at a predetermined gradient depending on specific heat of the water (Section C). Then, when the temperature of the water arrives at a temperature at which a phase change starts, the temperature of the water does not rise, and the water and water vapor coexist with each other while maintaining phase equilibrium. In this Section D, supplied heat is absorbed as latent heat for a phase transition that the water is vaporized to become the water vapor.

Then, as heat is applied to the water vapor, a temperature of the water vapor constantly rises depending on specific heat of the water vapor (Section E). On the contrary, when heat is taken away, the water vapor is subjected to phase transition sections of liquefaction and solidification in an opposite sequence to the above-mentioned sequence.

Meanwhile, in the defrosting operation, phase change sections of the frost generated at the time of the defrosting are Sections A, B, and C present within a dotted line box 510 in a graph of FIG. 5.

When viewing sections within the dotted line box 510, a section in which most of the heat is consumed when the heat is applied is Section B in which the phase change from the ice to the water is generated.

Again referring to FIG. 4, even though the defrosting for the lower portion of the evaporator 110 is completed by the heat of the defrosting heater 120 positioned closely to the lower portion of the evaporator 110, the frost formed at the upper portion of the evaporator 110 may be yet in the ice state or be in Section A or Section B in which the phase change is being made.

In this case, when the operation of the defrosting heater 120 is continuously performed until the frost at the upper portion of the evaporator 110 is changed into Section C by the convection of the heat generated by the defrosting heater 120, a required amount or more of heat is supplied to the lower portion of the evaporator 110 after the defrosting is completed.

Therefore, in the control scheme in which the defrosting apparatus of FIG. 2 or FIG. 3 intermittently performs the heating, a time required for an excessive amount of heat applied to the lower portion of the evaporator to be diffused to the upper portion of the evaporator is secured, thereby making it possible to improve efficiency.

Figure 6:
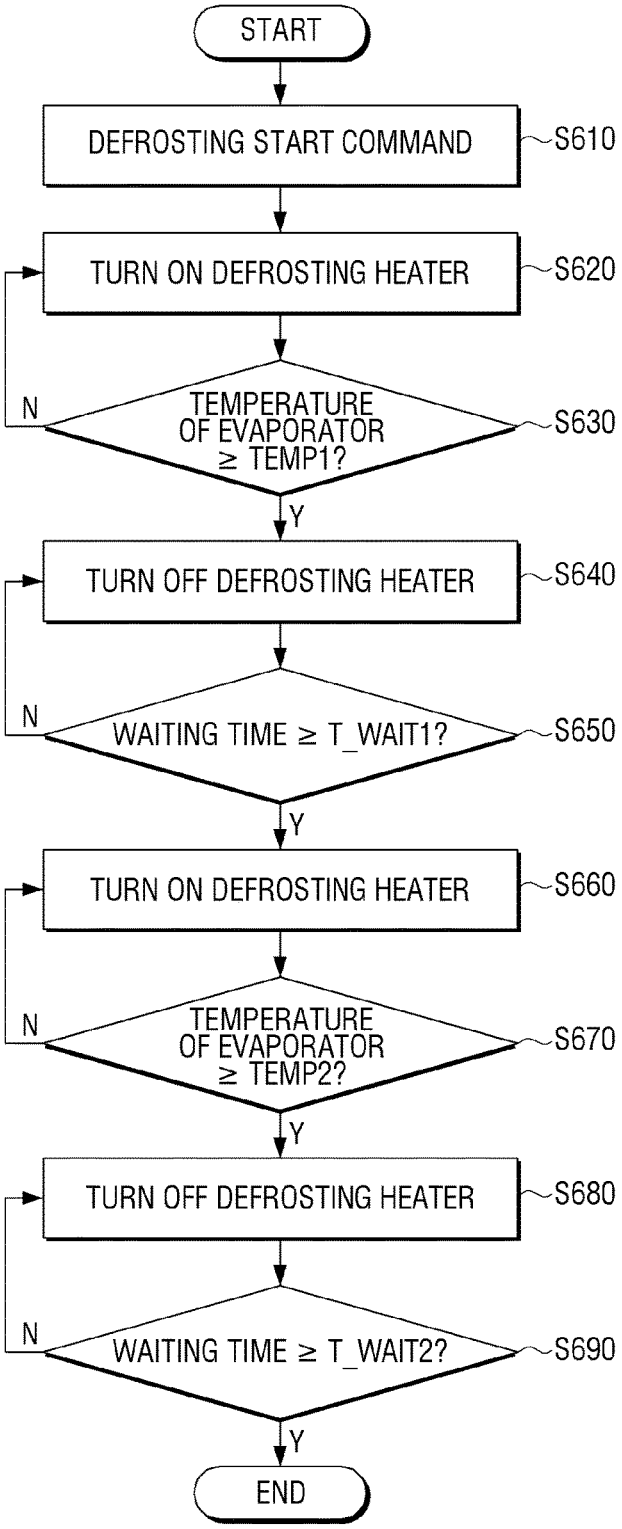
FIG. 6 is a flow chart for describing an operation of a defrosting apparatus according to an exemplary embodiment of the present disclosure.

FIG. 6 is a flow chart for describing an operation of a defrosting apparatus according to an exemplary embodiment of the present disclosure.

Referring to FIG. 6, a defrosting start command is input by a sensor sensing a thickness of the frost formed on the evaporator or when an added-up time for an operation of the compressor arrives at a predetermined time (operation S610). Here, as a process of preparing the defrosting before the defrosting start command is input, the driving of the evaporator may be stopped, and a duct of the cooling chamber that is opened may be closed.

When the defrosting start command is input, the defrosting heater is turned on (operation S620). In detail, a command is issued to start an initial operation of the defrosting heater for removing the frost in the defrosting operation.

Then, it is decided whether the temperature in the vicinity of the evaporator arrives at a predetermined temperature (operation S630). In detail, it may be decided that the temperature sensed from the temperature sensor disposed in the vicinity of the evaporator arrives at temp1, which is the predetermined temperature. In this case, when the temperature in the vicinity of the evaporator does not arrive at the predetermined temperature temp1 or more at the time of initially heating the evaporator (operation S630: N), the operation of the defrosting heater is continued (operation S620). Here, the predetermined temperature temp1 may be lower than a temperature at which the defrosting is completed.

When it is decided that the temperature sensed in the vicinity of the evaporator is the predetermined temperature or more (operation S630: Y), the defrosting heater is turned off (operation S640). In detail, the defrosting apparatus may allow the defrosting heater to enter the idle state to have a waiting time in which the heat generated in the defrosting heater is diffused to the entirety of the evaporator after initially heating the evaporator.

Then, it is decided whether the waiting time after the defrosting heater enters the idle state arrives at a predetermined time (operation S650). In detail, the idle state of the defrosting heater may be maintained for T_wait1, which is a first waiting time from a time in which the defrosting heater is first turned off (operation S650: N).

When the waiting time in which the defrosting heater is turned off becomes the predetermined time or more (operation S650: Y), the defrosting heater is turned on (operation S660). In detail, the defrosting heater maintained in the idle state for the predetermined waiting time in order to diffuse the heat may resume the defrosting operation.

The defrosting heater resuming the defrosting operation is continuously operated until the temperature in the vicinity of the evaporator arrives at a predetermined temperature (operation S670). In detail, it is decided whether the temperature sensed from the temperature sensor disposed in the vicinity of the evaporator arrives at a predetermined temperature Temp2 to continuously operate the defrosting heater (operation S670: N). Here, the predetermined temperature temp2 may be a predetermined temperature at which the defrosting is completed.

When a temperature of the evaporator rising by resuming the operation of the defrosting heater arrives at the predetermined temperature (operation S670: Y), the defrosting heater is again turned off (operation S680). In detail, the defrosting heater may have the idle section in which it is turned off so that the heat generated by resuming the operation of the defrosting heater is diffused to various places of the cooling chamber in which the evaporator is installed. In addition, a waiting time in which the defrosting heater is turned off to allow the defrosted water to flow out before the remaining water refreezes by resuming the cooling operation of the evaporator and cooling the heated evaporator naturally may be provided.

Next, it is decided whether or not the waiting time counted from a time in which the defrosting heater is turned off for the second time is a predetermined waiting time T_wait2 (operation S690). In detail, a control may be performed so that the idle section is maintained by the predetermined waiting time T_wait2 (operation S690: N).

When the waiting time of the predetermined waiting time T_wait2 or more elapses (operation S690: Y), the defrosting operation ends. When the defrosting operation ends, the evaporator may again perform a heat exchange depending on a cooling cycle, and the duct of the cooling chamber may be opened.

The control scheme in which the defrosting heater is turned on to be operated and is then turned off depending on the sensed temperature in the vicinity of the evaporator to have the idle section based on the predetermined time has been described hereinabove. However, a scheme of maintaining the idle section may not be time-dependent, but may be a scheme of sensing a rising temperature difference by only the diffusion of the heat in a state in which the defrosting heater is turned off.

Figure 7:
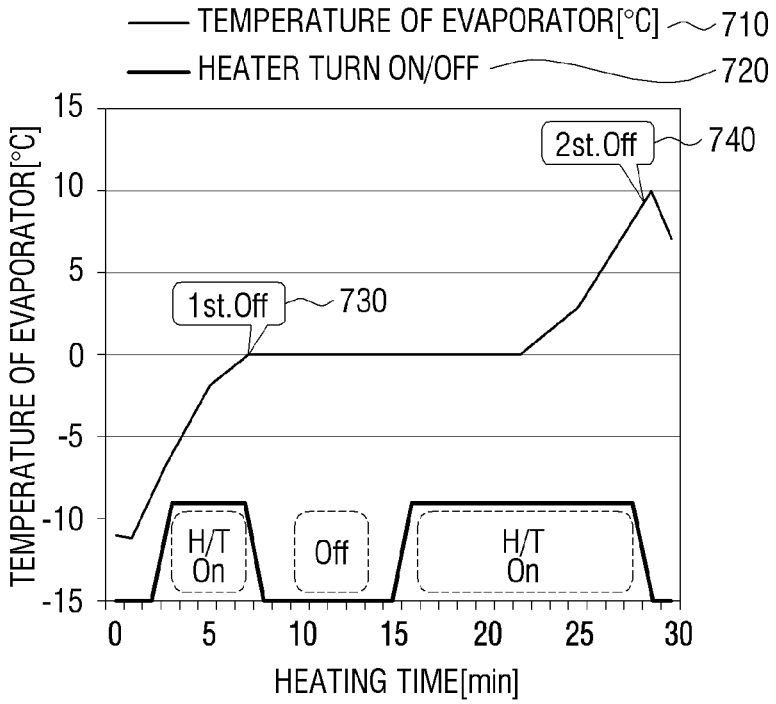
FIG. 7 is a graph illustrating timing of a control signal for an operation of the defrosting apparatus of FIG. 6 and a temperature change of an evaporator.

FIG. 7 is a graph illustrating timing of a control signal depending on an operation of the defrosting apparatus of FIG. 6 and a temperature change of an evaporator.

Referring to FIG. 7, a graph 710 for the temperature in the vicinity of the evaporator for a time from a state of the defrosting operation to an end of the defrosting operation and a graph 720 for timing of a control signal for controlling the turn on/off the defrosting heater are illustrated.

When the driving start command indicating the defrosting operation start is input, the control signal for operating the defrosting heater is set to a high state, and the defrosting heater is turned on for a section in which the control signal is in the high state.

When the temperature in the vicinity of the evaporator rises by the operation of the defrosting heater to arrive at a predetermined temperature of 0° C. at which the phase change of the frost formed on the evaporator starts (730), the control signal is set to a low state to stop the operation of the defrosting heater.

The defrosting heater is stopped for a predetermined time, and the phase change of the frost is made up to the upper portion of the evaporator by hot air discharged from the defrosting heater to the evaporator for the idle section.

When the predetermined waiting time in which the defrosting heater is maintained in the idle state elapses, the control signal is again set to the high state to operate the defrosting heater.

Here, the control signal resuming the operation of the defrosting heater may be maintained in the high state until the temperature in the vicinity of the evaporator arrives at a predetermined temperature at which the defrosting is completed. As an example, the defrosting ends at a predetermined temperature of 10° C. in FIG. 7.

Alternatively, a temperature at which the phase change ends within a predetermined heating time after the defrosting heater is again driven is sensed, such that the control signal is maintained in the high state until the temperature in the vicinity of the evaporator arrives at a temperature at which the defrosting ends.

When the temperature in the vicinity of the evaporator arrives at a predetermined maximum temperature at which the defrosting is completed and the operation of the defrosting heater is stopped (740), the defrosting operation completely ends, and the evaporator may again perform a heat exchange for a cooling cycle. In this case, the temperature in the vicinity of the evaporator rapidly falls as shown in the graph of FIG. 7.

However, as in the flow chart of FIG. 6, the defrosting heater may again have the idle section before the defrosting operation ends.

Figure 8:
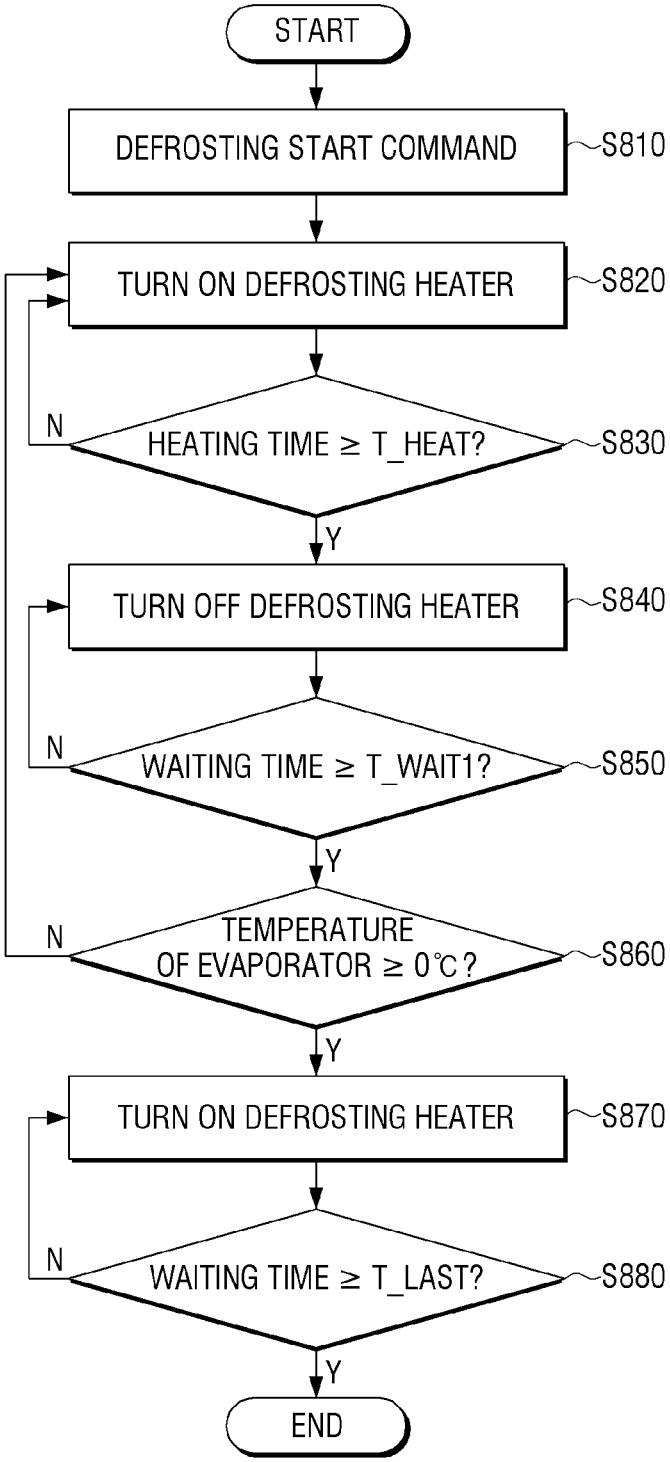
FIG. 8 is a flow chart for describing an operation of a defrosting apparatus according to an exemplary embodiment of the present disclosure.

FIG. 8 is a flow chart for describing an operation of a defrosting apparatus according to an exemplary embodiment of the present disclosure.

First, the defrosting start command is input (operation S810). Then, the defrosting heater for removing the frost formed on the evaporator is turned on to be operated (operation S820). Then, a control is performed so that the heating time in which the defrosting heater is operated is continued for a predetermined time T_heat (operation S830).

After the predetermined heating time elapses, the defrosting heater is turned off in order to have the idle section (operation S840). Then, a control is performed so that a waiting time of the turned-off defrosting heater is continued for a predetermined time T_wait1 (operation S850).

When the predetermined time elapses, it is decided that the temperature in the vicinity of the evaporator is 0° C. or more at which the phase change of the frost is made (operation S860).

In the case in which the temperature in the vicinity of the evaporator does not yet arrive at 0° C. (operation S860: N), a procedure of operating the defrosting heater for the predetermined time and stopping the operation of the defrosting heater is again repeated (operation S820).

When it is sensed that the temperature in the vicinity of the evaporator is 0° C. or more (operation S860: Y) after the predetermined waiting time elapses, the defrosting heater is turned on for a predetermined heating time T_last (operation S870 and operation S880). The predetermined heating time T_last of the last process is to ensure removal of the remaining ice.

Although the case in which a control scheme for the defrosting includes procedures that are dependent on time such as the heating time and the waiting time has been described hereinabove, these procedures may be replaced by the procedure that is dependent on the temperature sensed in the vicinity of the evaporator of FIG. 6 described above. For example, in the last processes (operation S870 and operation S880), the defrosting heater may be turned on until the temperature sensed in the vicinity of the evaporator arrives at the predetermined temperature at which the defrosting is completed. Additionally, the control scheme may be based on various combinations of time and temperature.

Figure 9:
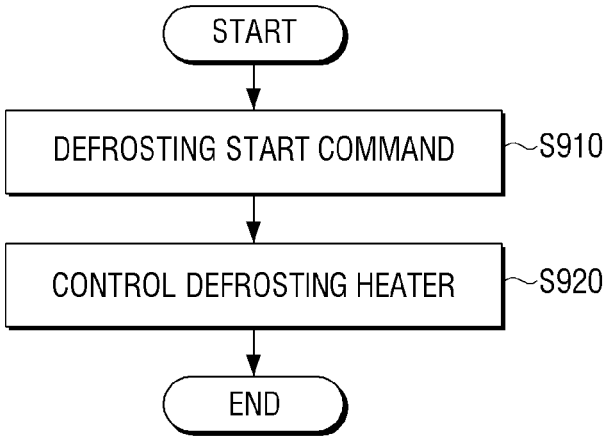
FIG. 9 is a flow chart for describing a control method of a defrosting apparatus according to an exemplary embodiment of the present disclosure.

FIG. 9 is a flow chart for describing a control method of a defrosting apparatus according to an exemplary embodiment of the present disclosure.

Referring to FIG. 9, in the control method of the defrosting apparatus including the defrosting heater for removing the frost formed on the evaporator, the defrosting start command is first input (operation S910). In detail, the defrosting start command may be a command received from the outside and allowing the defrosting operation to start and be a defrosting start command issued when conditions under which the defrosting is required are satisfied based on information received from the outside.

Next, the defrosting heater is controlled (operation S920). In detail, the defrosting heater is controlled until the temperature in the vicinity of the evaporator arrives at the predetermined temperature. In addition, the defrosting heater is controlled to have the idle section in which it is not operated from the input of the defrosting start command of operation S910 until the defrosting is completed. Here, the defrosting may be completed when the temperature in the vicinity of the evaporator arrives at the predetermined temperature.

In this case, the defrosting heater may be controlled to have the idle section at the temperature at which the phase change of the frost formed on the evaporator is made. The defrosting may be performed by the convection of the generated heat without supplying additional heat in a state in which a large amount of heat is consumed through the idle section at the temperature at which the phase change is made.

In addition, when it is confirmed in operation S910 that the temperature at which the phase change of the frost is completed is confirmed, the defrosting heater may be controlled to be operated until the temperature in the vicinity of the evaporator arrives at the predetermined temperature at which the defrosting is completed. That is, a control may be performed to continue the operation of the defrosting heater up to the predetermined temperature so that the defrosting apparatus rapidly completes the defrosting.

In operation S910, the defrosting heater 120 may be controlled to be additionally operated when the phase change of the frost is not completed for the predetermined time in the idle section. In other words, in the case in which the heat diffused in the idle state is insufficient to remove the frost, an additional operation of the defrosting heater may be performed.

In operation S910, the defrosting heater may be controlled to have at least one heating section in which the defrosting heater is operated for the predetermined heating time until the temperature in the vicinity of the evaporator arrives at the predetermined temperature and at least one idle section in which the defrosting heater 120 is stopped for the predetermined idle time.

In this case, the numbers of heating sections and idle sections of the defrosting heater may be controlled to be increased depending on whether or not the temperature in the vicinity of the evaporator arrives at the temperature at which the phase change of the frost is completed when the predetermined idle time elapses.

In addition, the defrosting heater 120 may be controlled to further have one heating section and one idle section in the case in which it is confirmed that the temperature in the vicinity of the evaporator 110 is 0° C. or less, when the predetermined idle time elapses.

When it is confirmed that the temperature at which the phase change of the frost is completed, the defrosting heater may be controlled to be operated until the temperature in the vicinity of the evaporator arrives at the predetermined temperature. That is, in a process of finishing the defrosting operation, a control may be performed to continue the operation of the defrosting heater up to the predetermined temperature at which the defrosting is completed in order to rapidly perform the defrosting.

In the control method of the defrosting apparatus including the defrosting heater as described above, the defrosting heater is controlled to be discontinuously operated at the time of the defrosting operation, thereby making it possible to improve energy efficiency at the time of the defrosting operation and food storing performance of the refrigerator. In addition, a problem that the evaporator, and the like, is twisted due to a phenomenon that the cooling chamber is non-uniformly heated and over-heated, such that it is thermally expanded and is contracted at the time of being cooled may be decreased.

In addition, the control method of a defrosting apparatus according to an exemplary embodiment of the present disclosure may be implemented in the defrosting apparatus of FIG. 2 or FIG. 3. In addition, the control method of a defrosting apparatus may also be implemented by program codes stored in various types of recording media and executed by a CPU, or the like.

In detail, the program codes for performing the control method of a defrosting apparatus may be stored in various types of recording media that is readable by a terminal, such as a RAM, a flash memory, a ROM, an erasable programmable ROM (EPROM), an electronically erasable programmable ROM (EEPROM), a register, a hard disk, a removable disk, a memory card, a universal serial bus (USB) memory, a compact-disk (CD) ROM, and the like.

Meanwhile, although the case in which all the components configuring an exemplary embodiment of the present disclosure are combined with each other as one component or are combined and operated with each other has been described, the present disclosure is not necessarily limited thereto. That is, all the components may also be selectively combined and operated with each other as one or more component without departing from the scope of the present disclosure. In addition, although each of all the components may be implemented by one independent hardware, some or all of the respective components which are selectively combined with each other may be implemented by a computer program having a program module performing some or all of functions combined with each other in one or plural hardware. Codes and code segments configuring the computer program may be easily inferred by those skilled in the art to which the present disclosure pertains. The computer program is stored in non-transitory computer readable media and is read and executed by a computer, thereby making it possible to implement an exemplary embodiment of the present disclosure.

Here, the non-transitory computer readable medium is not a medium that stores data therein for a while, such as a register, a cache, a memory, or the like, but refers to a medium that semi-permanently stores data therein and is readable by a device. In detail, the programs described above may be stored and provided in the non-transitory computer readable medium such as a CD, a digital versatile disk (DVD), a hard disk, a Blu-ray disk, a USB, a memory card, a ROM, or the like.

The above-described embodiments may be recorded in computer-readable media including program instructions to implement various operations embodied by a computer. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although exemplary embodiments of the present disclosure have been illustrated and described, the present disclosure is not limited to the above-mentioned specific exemplary embodiment, but may be variously modified by those skilled in the art to which the present disclosure pertains without departing from the spirit and scope of the present disclosure as claimed in the claims. In addition, such modifications should also be understood to fall within the scope of the present disclosure.

What is claimed is:

1. A defrosting apparatus comprising:

an evaporator;

a defrosting heater to defrost frost formed on the evaporator; and a controller to control the defrosting heater based on a driving start command received for the defrosting apparatus, wherein the controller controls the defrosting heater to comprise an idle period, in which the defrosting heater is not operated, between a point in time in which the driving start command is received and a point in time in which the defrosting is completed, to comprise the idle period at a temperature at which a phase change of the frost formed on the evaporator occurs, and wherein the controller increases a number of heating periods and idle periods if the phase change of the frost is not completed for a predetermined time in the idle period.

2. The defrosting apparatus as claimed in claim 1, wherein the controller controls the defrosting heater to operate until a temperature in the vicinity of the evaporator arrives at a predetermined temperature, thereby completing the defrosting for the evaporator.

3. The defrosting apparatus as claimed in claim 2, wherein the controller controls the defrosting heater to be operated until the temperature in the vicinity of the evaporator arrives at the predetermined temperature if the temperature at which the phase change of the frost is completed is confirmed.

4. The defrosting apparatus as claimed in claim 1, wherein the controller controls the defrosting heater to comprise at least one heating period in which the defrosting heater is operated for a predetermined heating time and at least one idle period in which the defrosting heater is stopped for a predetermined idle time until the defrosting is completed.

5. The defrosting apparatus as claimed in claim 4, wherein the controller controls the defrosting heater to further comprise one heating period and one idle period in the case in which it is confirmed that the temperature in the vicinity of the evaporator is 0° C. or less, if the predetermined idle time elapses.

6. The defrosting apparatus as claimed in claim 4, wherein the controller controls the defrosting heater to be operated until the temperature in the vicinity of the evaporator arrives at the predetermined temperature if the temperature at which the phase change of the frost is completed is confirmed.

7. The defrosting apparatus as claimed in claim 1, further comprising a temperature sensor sensing a temperature in the vicinity of the evaporator, wherein the defrosting heater is disposed below the evaporator, and the temperature sensor is mounted above the evaporator.

8. A control method of a defrosting apparatus including a defrosting heater for removing frost formed on an evaporator, comprising:

receiving a driving start command for the defrosting apparatus; and controlling the defrosting heater until a temperature in the vicinity of the evaporator arrives at a predetermined temperature, wherein the defrosting heater is controlled to comprise an idle period in which the defrosting heater is not operated between a point in time in which the driving start command is input and a point in time in which the temperature in the vicinity of the evaporator arrives at the predetermined temperature, to comprise the idle period at a temperature at which a phase change of the frost formed on the evaporator occurs, and wherein the controller increases a number of heating periods and idle periods if the phase change of the frost is not completed for a predetermined time in the idle period.

9. The control method of a defrosting apparatus as claimed in claim 8, wherein the defrosting heater is controlled to be operated until the temperature in the vicinity of the evaporator arrives at the predetermined temperature if the temperature at which the phase change of the frost is completed is confirmed.

10. The control method of a defrosting apparatus as claimed in claim 8, wherein the defrosting heater is controlled to comprise at least one heating period in which the defrosting heater is operated for a predetermined heating time until the temperature in the vicinity of the evaporator arrives at the predetermined temperature and at least one idle period in which the defrosting heater is stopped for a predetermined idle time.

11. The control method of a defrosting apparatus as claimed in claim 10, wherein the defrosting heater is controlled to further comprise one heating period and one idle period in the case in which it is confirmed that the temperature in the vicinity of the evaporator is 0° C. or less, if the predetermined idle time elapses.

12. The control method of a defrosting apparatus as claimed in claim 10, wherein the defrosting heater is controlled to be operated until the temperature in the vicinity of the evaporator arrives at the predetermined temperature if the temperature at which the phase change of the frost is completed is confirmed.

13. A refrigerator comprising:

an evaporator performing a heat exchange to lower a temperature within a storage chamber of the refrigerator;

a defrosting heater to defrost frost formed on the evaporator; and a controller to control the defrosting heater based on a driving start command received for a defrosting operation, wherein the controller controls the defrosting heater to comprise an idle period in which the defrosting heater is not operated between a point in time in which the driving start command is received and a point in time in which the temperature in the vicinity of the evaporator arrives at a predetermined temperature, to comprise the idle period at a temperature at which a phase change of the frost formed on the evaporator occurs, and wherein the controller increases a number of heating periods and idle periods if the phase change of the frost is not completed for a predetermined time in the idle period.

14. A computer readable recording medium including a program for executing a control method of a defrosting apparatus including a defrosting heater for defrosting frost formed on an evaporator, wherein the control method of the defrosting apparatus includes:

receiving a driving start command for the defrosting apparatus; and controlling the defrosting heater until a temperature in the vicinity of the evaporator arrives at a predetermined temperature, wherein the defrosting heater is controlled to comprise an idle period in which the defrosting heater is not operated between a point in time in which the driving start command is input and a point in time in which the temperature in the vicinity of the evaporator arrives at the predetermined temperature, to comprise the idle period at a temperature at which a phase change of the frost formed on the evaporator occurs, and wherein the controller increases a number of heating periods and idle periods if the phase change of the frost is not completed for a predetermined time in the idle period.

* * * * *